US007009130B2

(12) United States Patent
Hashimoto et al.

(10) Patent No.: US 7,009,130 B2
(45) Date of Patent: Mar. 7, 2006

(54) SWITCHING DEVICE

(75) Inventors: Hiroaki Hashimoto, Ibaraki-ken (JP); Kiyoshi Okumura, Ibaraki-ken (JP); Shinji Seto, Ibaraki-ken (JP)

(73) Assignee: Hitachi, Ltd., Tokyo (JP)

( * ) Notice: Subject to any disclaimer, the term of this patent is extended or adjusted under 35 U.S.C. 154(b) by 221 days.

(21) Appl. No.: 10/732,487

(22) Filed: Dec. 11, 2003

(65) Prior Publication Data

US 2004/0179318 A1 Sep. 16, 2004

(30) Foreign Application Priority Data

Mar. 11, 2003 (JP) ..... 2003-064323

(51) Int. Cl.
*H01H 9/40* (2006.01)

(52) U.S. Cl. ..... 200/400; 218/154

(58) Field of Classification Search ..... 200/17 R, 200/400, 401, 500, 501, 318; 218/154; 335/171–179
See application file for complete search history.

(56) References Cited

U.S. PATENT DOCUMENTS 4,153,828 A * 5/1979 Barkan ..... 200/400
4,649,244 A * 3/1987 Baginski et al. ..... 200/501
5,107,715 A * 4/1992 Thuries ..... 74/2
5,151,567 A * 9/1992 Thuries ..... 218/84
5,981,889 A * 11/1999 Niklaus ..... 200/501
6,013,886 A * 1/2000 Gimeno et al. ..... 200/400
6,917,006 B1 * 7/2005 Bachofen ..... 200/400

FOREIGN PATENT DOCUMENTS

| | | |
|---|---|---|
| JP | 2001-283691 | 10/2001 |
| JP | 2002-216595 | 8/2002 |
| JP | 2002-532842 | 10/2002 |
| WO | 00/36621 | 6/2000 |

* cited by examiner

*Primary Examiner*—Michael A. Friedhofer
(74) *Attorney, Agent, or Firm*—Crowell & Moring LLP

(57) ABSTRACT

A switching device changes over breaking and closing of an electric current by opening/closing a contact portion. An electrically-operated motor generates energy for closing a contact and energy generated by the rotation of the electrically-operated motor is accumulated in a breaking spring. The energy generated by the electrically-operated motor is transmitted to the contact by way of a cam, a breaking spring link, a transfer lever and the like. The breaking spring is arranged in the midst of the converting lever. When the contact is opened, the electrically-operated motor is stopped and the energy accumulated in the breaking spring is released.

11 Claims, 11 Drawing Sheets

SWITCHING DEVICE

BACKGROUND OF THE INVENTION

The present invention relates to a switching device of a breaker provided to a substation or a switching station.

An example of a conventional switching device is described in Japanese Unexamined Patent Publication 2001-283691. An operating apparatus of the switching device described in this publication uses coil springs as a drive source for breaking and closing an electric current. Then, in a turn on state, respective springs are compressed to hold driving energy, while when an open/close command is issued, the driving energy of the springs is released so as to open/close a contact. At the time of opening/closing the contact, the contact is closed and a breaking spring is compressed using a cam.

An example of an operating apparatus of a circuit breaker which opens or closes the contact without using a cam is described in Japanese Unexamined Patent Publication 2002-216595. In the operating device described in the publication, for shortening time from closing of an opening/closing contact to starting of a next closing operation, an operating apparatus includes first and second breaking levers and an closing lever. Then, the first breaking lever is connected to the open/close contact and is imparted with a torque in the counterclockwise direction due to a torsion bar for a breaking circuit, while the second breaking lever is connected to the first breaking lever by way of a link device. The closing lever is imparted with a torque in the clockwise direction by a torsion bar for a closing circuit by way of a lever.

An example of an operating apparatus which opens/closes a switching device using an electric energy is described in Japanese Unexamined Patent Publication 2002-532842 through PCT. The operating device described in the publication is served for an electric switching device for high voltage or intermediate voltage such as a circuit breaker and includes an electrically-operated motor which is connected to a moving contact of the switching device. The electrically-operated motor, at the time of performing a breaking operation of the moving contact, accumulates a kinetic energy of a moving contact in a proper form or converts the kinetic energy and supplies the converted energy to a supply unit.

In the operating apparatus described in the above-mentioned Japanese Unexamined Patent Publication 2001-283691, a mechanism which holds or releases driving energies at the time of performing both of the breaking operation and the closing operation is necessary and hence, many parts are used whereby there exists a demand for further enhancement of miniaturization and reduction of weight. In the operating device described in Japanese Unexamined Patent Publication 2002-216595, although the operating time can be shortened, the consideration on the miniaturization and the enhancement of reliability of the operating apparatus by simplifying the operating mechanism is less than optimal. Still further, the electrically-operated motor of Japanese Unexamined Patent Publication 2002-532842 through PCT makes use of the electric energy at the time of performing the breaking operation and the closing operation and hence, when an operating voltage is lowered due to the occurrence of a trouble in a power source or the like in a substation, there may be a case that the switching operation becomes impossible.

BRIEF SUMMARY OF THE INVENTION

The present invention has been made in view of the above-mentioned drawbacks of the prior art and it is an advantage of the present invention to simplify an operating mechanism of an operating apparatus used in a switching device. With the provision of the simplified operating mechanism, the switching device can be miniaturized.

It is another advantage of the present invention to enhance the energy efficiency by reducing energy necessary for breaking or closing a switching device.

It is still another advantage of the present invention to enhance the reliability of operation while miniaturizing the whole switching device including an operating apparatus.

It is an object of the present invention to achieve at least one of these advantages.

The constitutional feature of the present invention to achieve the above-mentioned object lies in that, in a switching device which performs breaking and closing of an electric current by opening/closing a contact, the switching device includes an electrically-operated motor which generates energy for closing the contact, energy accumulation means which accumulates energy generated by rotation of the electrically-operated motor, and transmission means which transmits energy generated by the electrically-operated motor to the contact, wherein the energy accumulation means is arranged in the midst of the transmission means, and when the contact is opened, the electrically-operated motor is stopped and the energy accumulated in the energy accumulation means is released.

In this technical feature, it is preferable that the transmission means includes means which transmits the energy generated by the electrically-operated motor to the contact and does not transmit the energy from the contact side to the electrically-operated motor side. It is also preferable to provide a breaking operation means which engages with the midst of the transmission means and regulates the movement of the contact.

It is further preferable that the transmission means includes a cam shaft, a cam which is mounted on an end portion of the cam shaft, a roller which is brought into contact with the cam, a breaking spring link which has the roller connected to one end portion thereof, and a transfer lever which is mounted on another end portion of the breaking spring link, wherein the energy accumulation means is held by the breaking spring link, a second roller is mounted on the cam, and a breaking operation means includes a breaking lever which engages with the second roller, a breaking trigger which is brought into contact with the breaking lever and a solenoid which activates the breaking trigger.

Another constitutional feature of the present invention to achieve the above-mentioned object lies in that, in a switching device which changes over breaking and closing of an electric current by opening/closing between a fixed contact and a moving contact, the switching device includes accumulation means which releases accumulated energy when the electric current is cut off and accumulates energy for breaking when an electric current is put in, and an electrically-operated motor which is mechanically connected to the accumulation means and accumulates a breaking energy, and when the electric current is put in, energy generated by the electrically-operated motor is directly transmitted to the moving contact without an alternative route.

In such a constitutional feature, it is preferable that the switching device includes means which does not transmit power from the accumulation means to the electrically-operated motor and transmits the power from the electrically-operated motor to the accumulation means and control means which controls the electrically-operated motor. It is preferable that the control means controls the operation timing of the electrically-operated motor based on an electric current for a main circuit provided to the switching element, a voltage between poles and displacement and speed of the moving contact which are inputted to the control device. It is also preferable that the accumulation means includes at least either one of a cam and a spring and the switching device is at least either one of a breaker or an isolator for electric power.

Still another constitutional feature of the present invention to achieve the above-mentioned object lies in that, in a switching device which changes over breaking and closing of an electric current by opening/closing between a fixed contact and a moving contact, the switching device includes a spring which accumulates energy for breaking, a cam which releases the spring in a breaking operation and transmits energy to the spring in an closing operation, an electrically-operated motor which generates an closing energy and is mechanically connected to the cam, a breaking operation means which restricts the rotation of the cam, and control means which controls the electrically-operated motor and the breaking operation means, wherein the control operation means controls timing in which the energy of the spring is transmitted from the cam to the breaking operation means in an closing holding state and a command is inputted to the breaking operation means at the time of performing the breaking operation, and the control means controls the driving current of the electrically-operated motor at the time of performing the closing operation.

DETAILED DESCRIPTION OF THE INVENTION

The present invention is made based on a following novel finding obtained by inventors of the present invention. That is, when an electrical closing command is fed to a switching device during a breaking operation due to a trouble or the like of a control panel in a substation, an closing spring acts to prevent the release of a breaking spring so that the breaking operation is delayed. The embodiment of the present invention which can solve such a novel drawback is explained hereinafter in conjunction with attached drawings.

Figure 1:
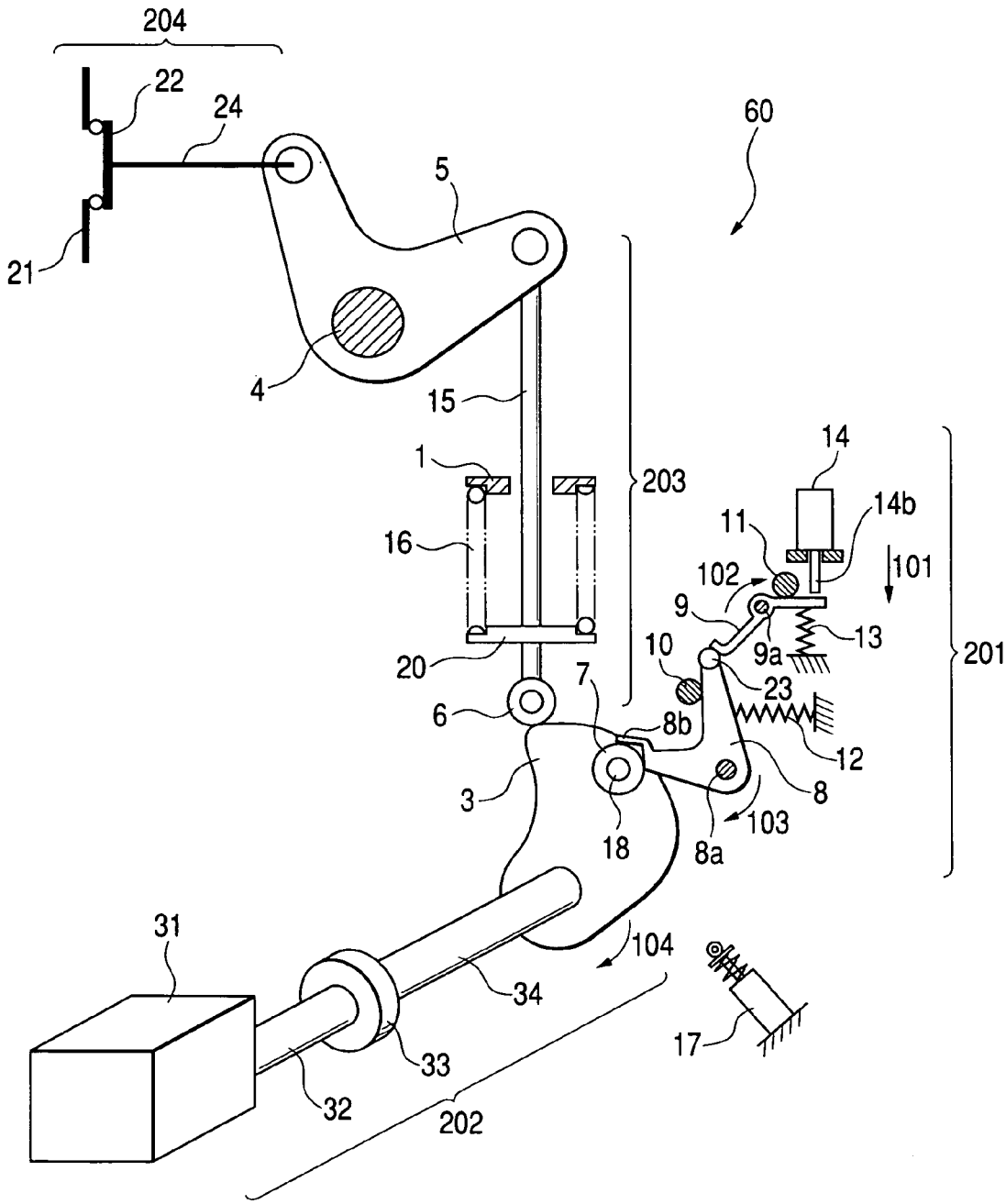
FIG. 1 is a schematic view showing one embodiment of a switching device according to the present invention.

FIG. 1 is a schematic view of an embodiment of a switching device according to the present invention and a view showing an closing state. The switching device 60 includes a breaking operation means 201, an closing driving part 202 which includes a cam 3 as a main component, a breaking spring part 203 which has one end portion thereof engaged with the cam 3, a transfer lever 5 and a contact 204 which turns in or brakes electric power. By releasing a spring force of the breaking spring 16 provided to the breaking spring part 203, a circuit is opened, while by driving an electrically-operated motor 31 of the closing driving part 202, the circuit is closed. At the time of performing the closing operation, the breaking spring 16 accumulates energy due to the rotation of the cam 3 driven by the motor 31.

The contact 204 includes a moving contact 22 and a fixed contact 21 with which one end of the moving contact 22 is brought into contact. The moving contact 22 is connected to one end of the transfer lever 5 by way of an insulator 24. The transfer lever 5 has a boomerang shape and is rotatably supported on a shaft 4 which is positioned in the vicinity of a bent corner portion of the transfer lever 5.

In the breaking spring portion 203, one end of a breaking spring link 15 is mounted on an end portion of the transfer lever 5 which is located opposite to a connection end thereof with the insulator 24. On the other end of the breaking spring link 15, a rotatable roller 6 is mounted. The roller 6 transmits a load to the cam 3 when the roller 6 is brought into contact with an outer peripheral surface of the cam 3 explained later. A spring seat 20 is mounted on a lower portion of the breaking spring link 15 and the breaking spring 16 is held by the spring seat 20. The spring seat 20 acts as a stopper of the breaking spring 16. The breaking spring 16 is a compression coil spring and the breaking spring link 15 penetrates a center portion of the breaking spring 16. An upper end surface of the breaking spring 16 is held by a housing 1.

In the closing driving part 202, the cam 3 is mounted on an end portion of a cam shaft 34. The cam shaft 34 is connected to a motor shaft 32 by way of a one-way clutch 33. Although the one-way clutch 33 does not transmit the rotation from the cam 3 side to the motor 31, the one-way clutch 33 transmits the rotation of the motor 31 to the cam 3. A reduction gear may be mounted on an end portion of the motor 31 or a reduction gear may be arranged between the motor 31 and the cam shaft 34. A pin 18 is fixed to an outer peripheral portion of the cam 3 in a projected manner and a roller 7 is rotatably mounted on the pin 18. A breaking lever 8 of the breaking operation means 201 engages with the roller 18.

In the breaking operation means 201, an intermediate portion of the breaking lever 8 having a boomerang shape is rotatably supported on a shaft 8*a*. An oblique portion 8*b* to which a load is transmitted from the roller 7 is formed on one end portion of the breaking lever 8. A roller 23 which engages with a breaking trigger 9 is mounted on the other end portion of the breaking lever 8. A restoring spring 12 which generates a force for always making the breaking lever 8 rotate in the counter clockwise direction is mounted on the roller 23 side of the breaking lever 8. A stopper 10 which restricts the movement of the breaking lever 8 in the counter clockwise direction is provided at a side opposite to the restoring spring 12 with the breaking lever 8 sandwiched therebetween.

The breaking trigger 9 is rotatably supported on a shaft 9*a*. A restoring spring 13 which generates a force for making the breaking trigger 9 always rotate in the counter clockwise direction is provided at an end side opposite to an engaging end with the roller 23. A stopper 11 which restricts the movement of the breaking trigger 9 is provided to a side opposite to the restoring spring 13 with the breaking trigger 9 therebetween. The restoring springs 12, 13 are formed of a compression coil spring. At an end portion of the breaking trigger 9, a plunger 14*b* of the breaking solenoid 14 is arranged such that the plunger 14*b* is brought into contact with the end portion of breaking trigger 9. A shock absorber 17 which controls the cam 3 and, at the same time, defines the rotation of the cam 3 upon compression of the breaking operation is arranged in the vicinity of the cam 3.

Figure 2:
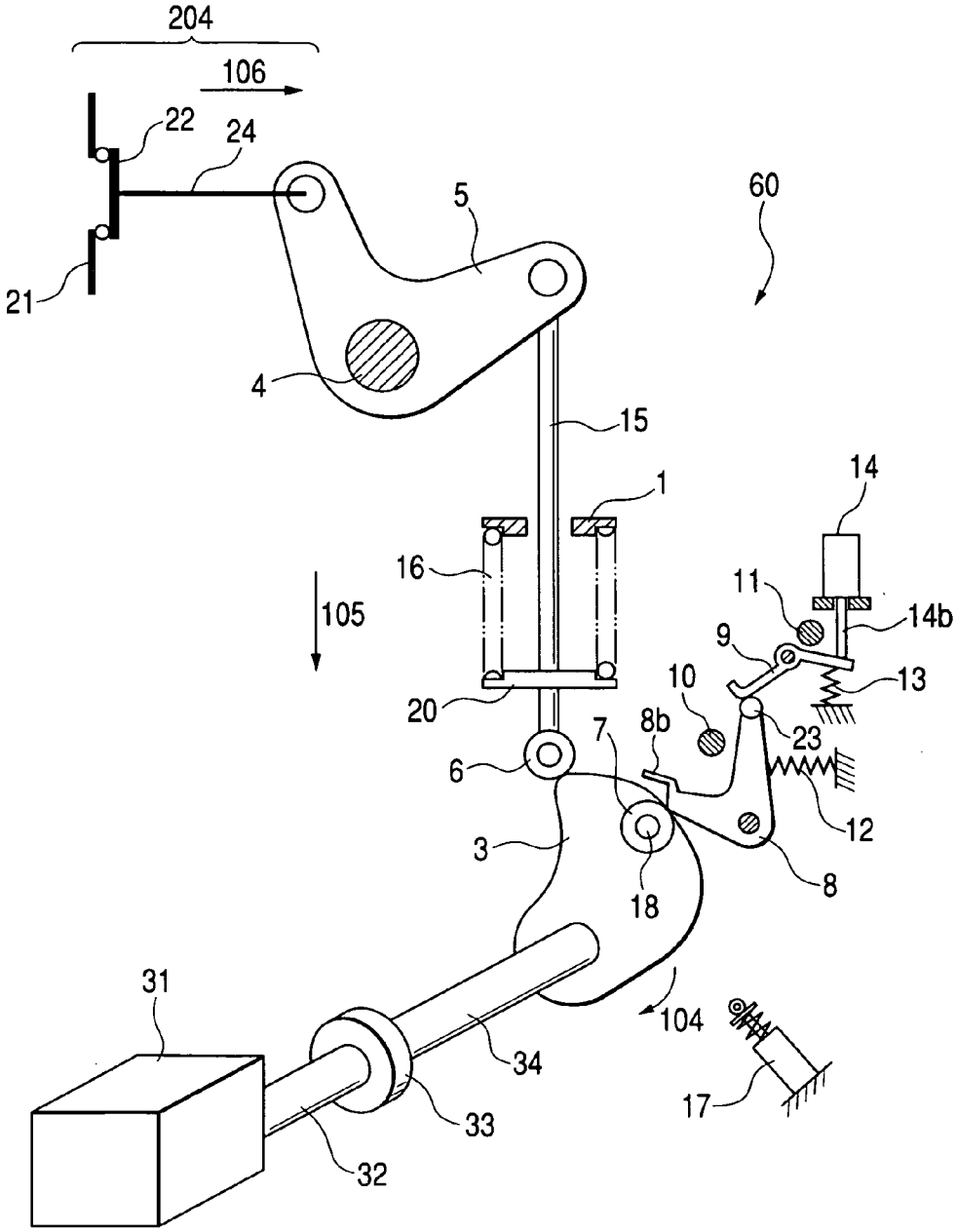
FIG. 2 to FIG. 6 are views for explaining the operation of the switching device.
Figure 3:
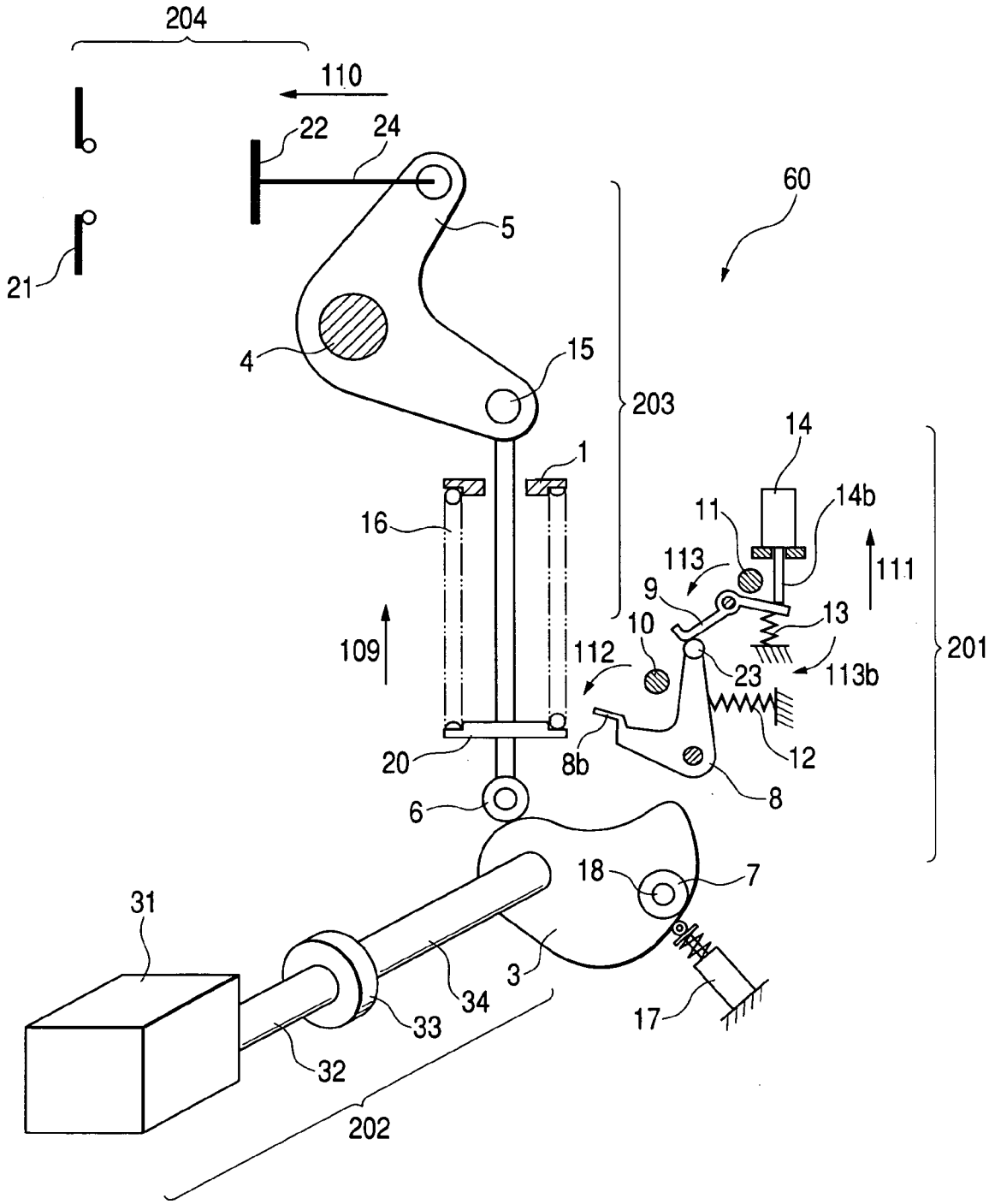
Figure 4:
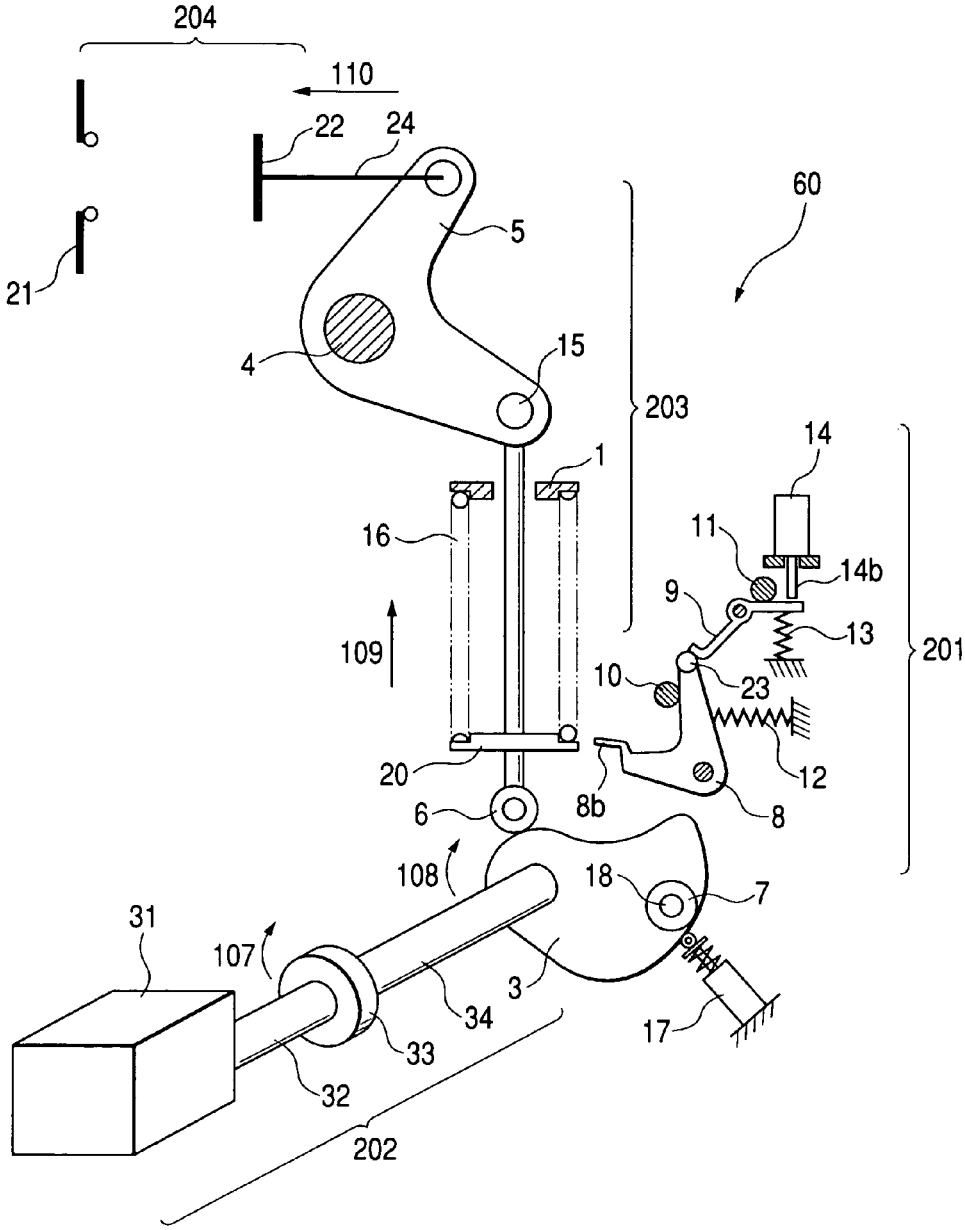
Figure 5:
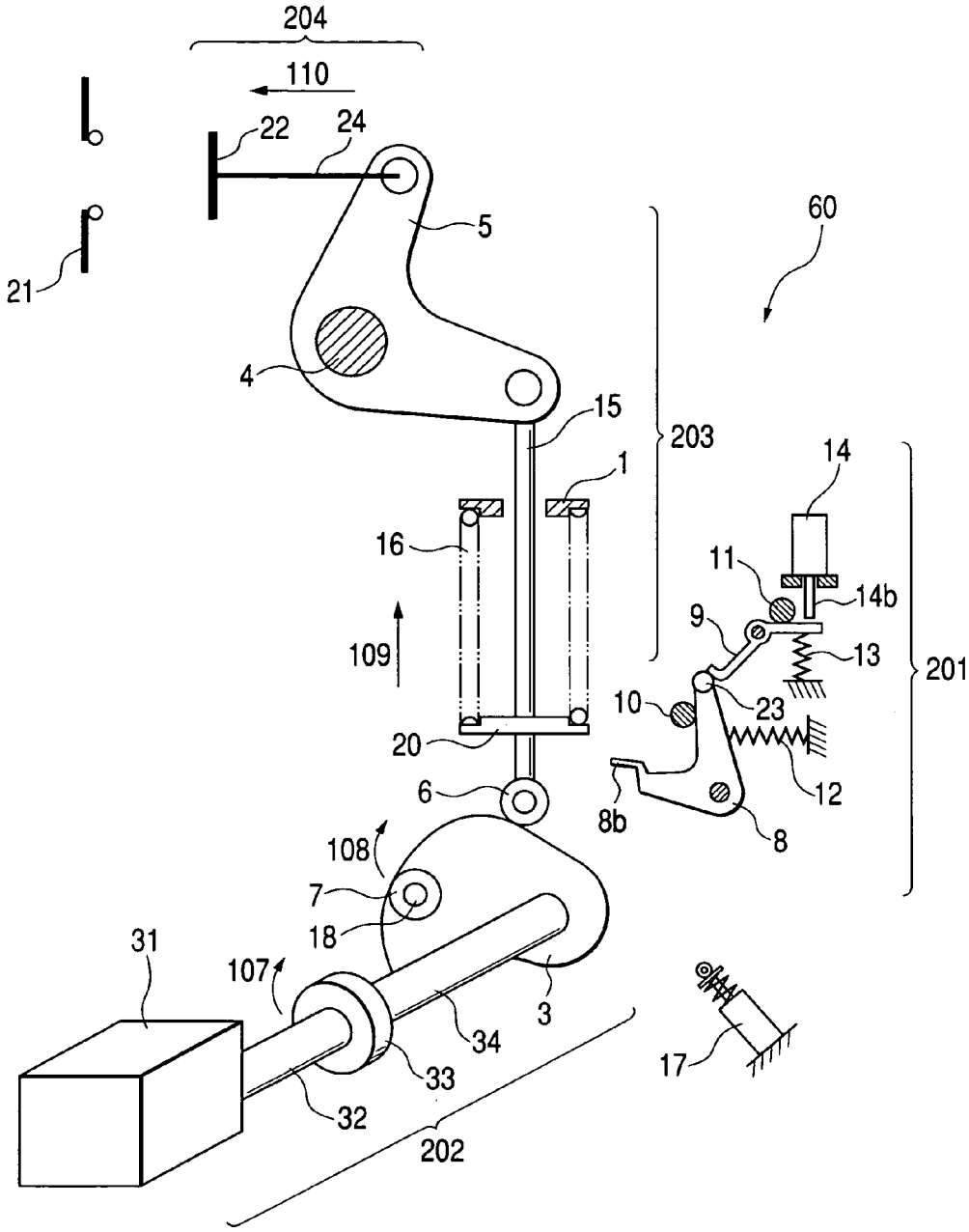
Figure 6:
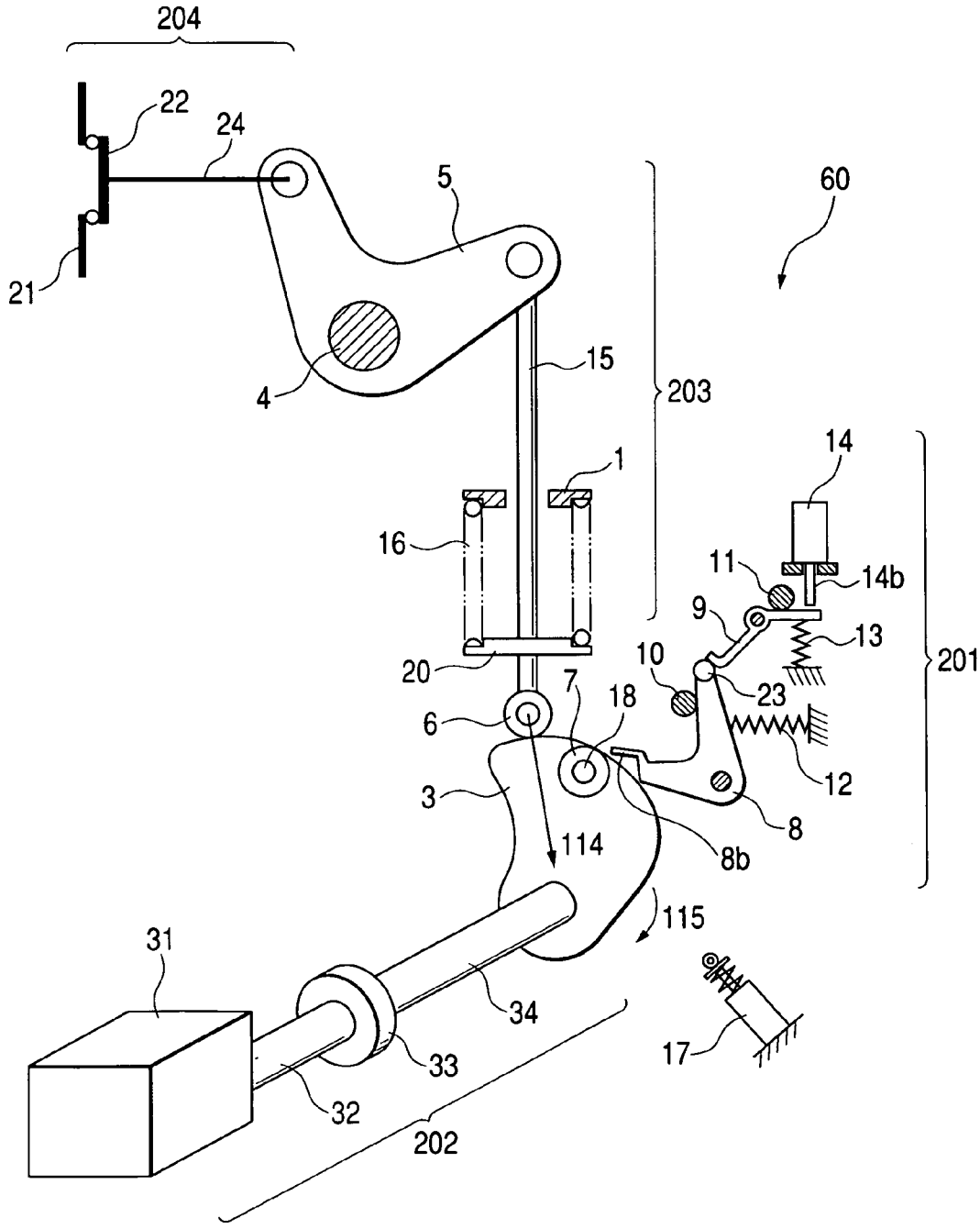

The manner of operation of the switching device 60 having such a constitution is explained in conjunction with FIG. 1 to FIG. 6. FIG. 1 is a view which shows the closing state, FIG. 2 is a view showing a state in the midst of the opening operation, FIG. 3 and FIG. 4 are views showing the opening state, FIG. 5 is the view showing a state in the midst of closing, and FIG. 6 is a view showing a state immediately before completion of the closing.

In FIG. 1, the breaking spring 16 is held in a compressed state. The spring force of the breaking spring 16 is transmitted to the cam 3 from the roller 6 mounted on the breaking spring link 15 by way of the spring seat 20. Since the roller 6 is brought into contact with the cam 3, a moment which makes the cam 3 rotate in the clockwise direction acts on the cam 3. However, since the roller 7 which is mounted on the cam 3 engages with the breaking lever 8, the rotation of the cam 3 is restricted. A load which is generated by the engagement of the breaking lever 8 with the roller 7 makes the breaking lever 8 rotate in the clockwise direction. Since the roller 23 which is mounted on the breaking lever 8 engages with the breaking trigger 9, the rotation of the breaking lever 8 is restricted. An engaging load which is transmitted from the roller 23 to the trigger lever 9 acts in the direction toward the center of rotation of the trigger lever 9 and hence, the rotation of the trigger lever 9 is restricted.

When a breaking instruction is inputted from a control device not shown in the drawing in the state shown in FIG. 1, the breaking solenoid 14 is energized. Accordingly, the plunger 14*b* of the breaking solenoid 14 projects and presses the breaking trigger 9 in the downward direction as indicated by an arrow 101. When a pressing force exerted by the plunger 14*b* exceeds the spring force of the restoring spring 13 so as to make the breaking trigger 9 rotate in the right direction as indicated by an arrow 102. The plunger 14*b* extends by a full stroke and holds the state in which the breaking trigger 9 is pressed. Accordingly, the engagement between the breaking trigger 9 and the breaking lever 8 is released.

As the engagement between the breaking trigger 9 and the breaking lever 8 is released, the breaking lever 8 is rotated in the right direction as indicated by an arrow 103. The engagement between the breaking lever 8 and the roller 7 is released. When the engagement between the breaking lever 8 and the roller 7 is released, the cam 3 starts to rotate in the right direction as indicated by an arrow 104. This state is shown in FIG. 2.

Along with the rotation of the cam 3 in the right direction, the cam shaft 34 is simultaneously rotated in the right direction. Due to the operation of the one-way clutch 33, the motor 31 and the cam 3 are mechanically separated from each other and hence, an inertial load of the motor 31 does not act on the cam 3. Accordingly, when the engagement between the breaking lever 8 and the roller 7 is released, the cam 3 starts to rotate immediately The roller 6 moves downwardly due to the spring force of the breaking spring 16. To prevent a contact with a roller 6, an outer periphery of the cam 3 has a retracted shape. That is, the roller 6 is not brought into contact with the cam 3 within a substantially constant diameter range formed on the cam 3.

When the breaking spring 16 is released, the breaking spring link 15 moves downwardly as indicated by an arrow 105. The transfer lever 5 which is connected to the breaking spring link 15 is rotated in the counter clockwise direction. Along with such a rotation, the moving contact 22 which is connected to the transfer lever 5 is moved to the right side as indicated by an arrow 106 so that the contact 204 is opened.

The cam 3 continues to rotate in the right direction indicated by the arrow 104. Thereafter, the cam 3 stops to rotate when an outer surface of the cam 3 is brought into contact with the shock absorber 17. When the roller 6 is brought into contact with the outer surface of the cam 3, the breaking spring link 15 is stopped as the cam 3 is stopped. The state in which the breaking operation is completed is shown in FIG. 3.

Along with the completion of the breaking operation, the breaking solenoid 14 assumes the non-energized state. The projected plunger 14*b* is made to return in the upward direction as indicated by an arrow 111. When the rotational restriction imparted to the breaking trigger 9 is eliminated, the breaking lever 8 is rotated in the left direction as indicated by an arrow 112 due to the restoring spring 12 and is brought into contact with the stopper 10. The roller 23 pushes the breaking trigger 9 so as to make the breaking trigger 9 rotate in the right direction as indicated by an arrow 113b. Thereafter, the return spring 13 makes the breaking trigger 9 rotate in the left direction as indicated by an arrow 113. The breaking trigger 9 is brought into contact with the stopper 11 and is stopped. Due to the above-mentioned steps, the restoring operation of the breaking operation means 201 is completed. This state is shown in FIG. 4.

The closing operation which shifts the switching device to the closing state shown in FIG. 1 from the breaking state shown in FIG. 4 will be explained. When an closing command is inputted from the control device not shown in the drawing, the motor 31 is energized and the motor shaft 32 starts to rotate in the right direction as indicated by an arrow 107. The one-way clutch 33 transmits the driving force of the motor 31 to the cam shaft 34 so as to make the cam 3 rotate in the right direction as indicated by an arrow 108. As the cam 3 and the roller 6 are brought into contact with each other, within a range that the cam 3 is rotated in the right direction by approximately 180°, the roller 6 does not move in the vertical direction. That is, the outer diameter of the cam 3 is formed constant in approximately half circumference of the cam 3.

By ensuring time in which the roller 6 does not move in the vertical direction in this manner, the start-up of the motor 31 becomes quick and hence, the breaking spring 16 can be compressed after the steady-state current is acquired. When the cam 3 is rotated further in the right direction as indicated by the arrow 108, the cam 3 pushes up the roller 6. Accordingly, the breaking spring link 15 is pushed up together with the stopper 20 as indicated by the arrow 109 and hence, the breaking spring 16 is compressed.

The roller 6 which is brought into contact with the cam 3 moves as a follower along a curve formed on the cam 3. Along with the upward movement of the breaking spring link 15, the transfer lever 5 is rotated in the counterclockwise direction and makes the moving contact 22 move in the left direction as indicated by the arrow 110. This state is shown in FIG. 5.

When the cam 3 is further rotated in the right direction as indicated by the arrow 108 and reaches a maximum diameter portion of the cam 3, the breaking spring link 15 arrives at a top dead center. A connection portion of the transfer lever 5 with the moving contact 22 is moved to the leftmost side. When the moving contact 22 is moved to the left side, the moving contact 22 is brought into contact with the fixed contact maker 21 and hence, the contact 204 is closed. This state is shown in FIG. 6.

When the closing of the contact is completed, the motor 31 is stopped. The breaking spring force acts downwardly as indicated by the arrow 114 on the cam 3 by way of the roller 6. The cam 3 is rotated in the right direction as indicated by the arrow 115. Since the maximum diameter portion of the cam 3 is formed in the peripheral direction by a given angle, even when the cam 3 is rotated in the right direction, the breaking spring link 15 is not moved vertically and the moving contact 22 is not moved. Then, when the cam 3 is further rotated in the right direction, the roller 7 engages with the oblique surface portion 8a of the breaking lever 8 and the closing holding state shown in FIG. 1 is restored. When the closing holding state is restored, it is possible to perform the opening operation again.

According to this embodiment, the cam 3 is made to perform both operations consisting of holding of the breaking spring force and the compression of the breaking spring 16 at the time of the closing operation, the cam shaft 34 is connected to the motor 3 which constitutes to close driving source and hence, compared to the conventional spring-type operating device, this embodiment can simplify the mechanism and can reduce the number of parts. The breaking operation means 201 is made to perform the restoring operation immediately after completion of the opening operation, only the roller 7 mounted on the cam 3 is brought into contact with the breaking lever 8 at the time of completion of the closing operation and hence, it is possible to hold the breaking spring force in a stable manner.

In the state that the electrical operation is impossible and the opening operation must be performed manually due to lowering of the operating voltage which is caused by the occurrence of a trouble in a power source or the like in a substation, the solenoid plunger 14*b* is pushed manually so as to release the engagement between the breaking trigger 9 and the breaking lever 8. Also with respect to the countermeasure in the emergency state, it is possible to breaking the switching device in the same manner as the usual electrical operation. Accordingly, compared to the conventional operating apparatus which uses the electrically-operated motor, the operability is enhanced. The manual closing operation is performed by driving the motor 31 from the outside using a manually operated handle or the like not shown in the drawing.

In the operating apparatus according to the present invention, the priority is given to the opening operation. This priority operation is explained hereinafter. The operation corresponds to a case in which a breaking instruction is inputted during the closing operation due to the occurrence of a trouble in the control panel or the like not shown in the drawing. When the breaking instruction is inputted in the state shown in FIG. 5, in spite of the fact the closing operation is under way, the engagement between the breaking lever 8 and the breaking trigger 9 in the breaking operation means 201 is released. By stopping the electrically-operated motor 31, the cam 3 is rotated in the counter clockwise direction due to the breaking spring force. Then, the breaking spring link 15 is pushed downwardly and the contact 204 is breaking. When the electrically-operated motor 31 cannot be stopped, the cam 3 is rotated to perform the operation to close the contact 204. Since the roller 7 and breaking lever 8 do not engage with each other, it is possible to open or close the contact immediately after the closing.

A case in which an closing instruction is inputted during the closing operation due to a trouble of the control panel or the like is explained hereinafter. When an closing instruction is inputted in error at a point of time that the cam 3 is released from the roller 6 in the state shown in FIG. 2, the motor 31 is energized and the cam 3 continues the rotational driving in the right direction. Accordingly, the opening operation of the contact 204 is continued. The cam 3 collides with the shock absorber 17 and is stopped.

When the closing instruction is inputted by an error before the cam 3 leaves the roller 6, the motor 31 rotates the cam 3 in the right direction. In this case, the time that the cam 3 leaves the roller 6 is shortened and hence, the start of the operation of the moving contact 22 becomes quick. The contact 204 is surely breaking. In any cases, even when the erroneous operation command is inputted, the operating apparatus can surely perform the opening operation.

Although the compression coil is used as the breaking spring 16 in this embodiment, other resilient element such as a coned disc spring may be used. For simplifying the structure, the breaking spring link 15 is configured to move the moving contact 22. A lever or a link for increasing a length of stroke of the moving contact 22 may be provided between the transfer lever 5 and the moving contact 22.

Further, in this embodiment, the restoring springs which are formed on the latch and the trigger always impart a spring force and these restoring springs are formed of the coil spring. However, these restoring springs may be formed of other resilient element. The operating apparatus may include a plurality of breaking springs.

Figure 7:
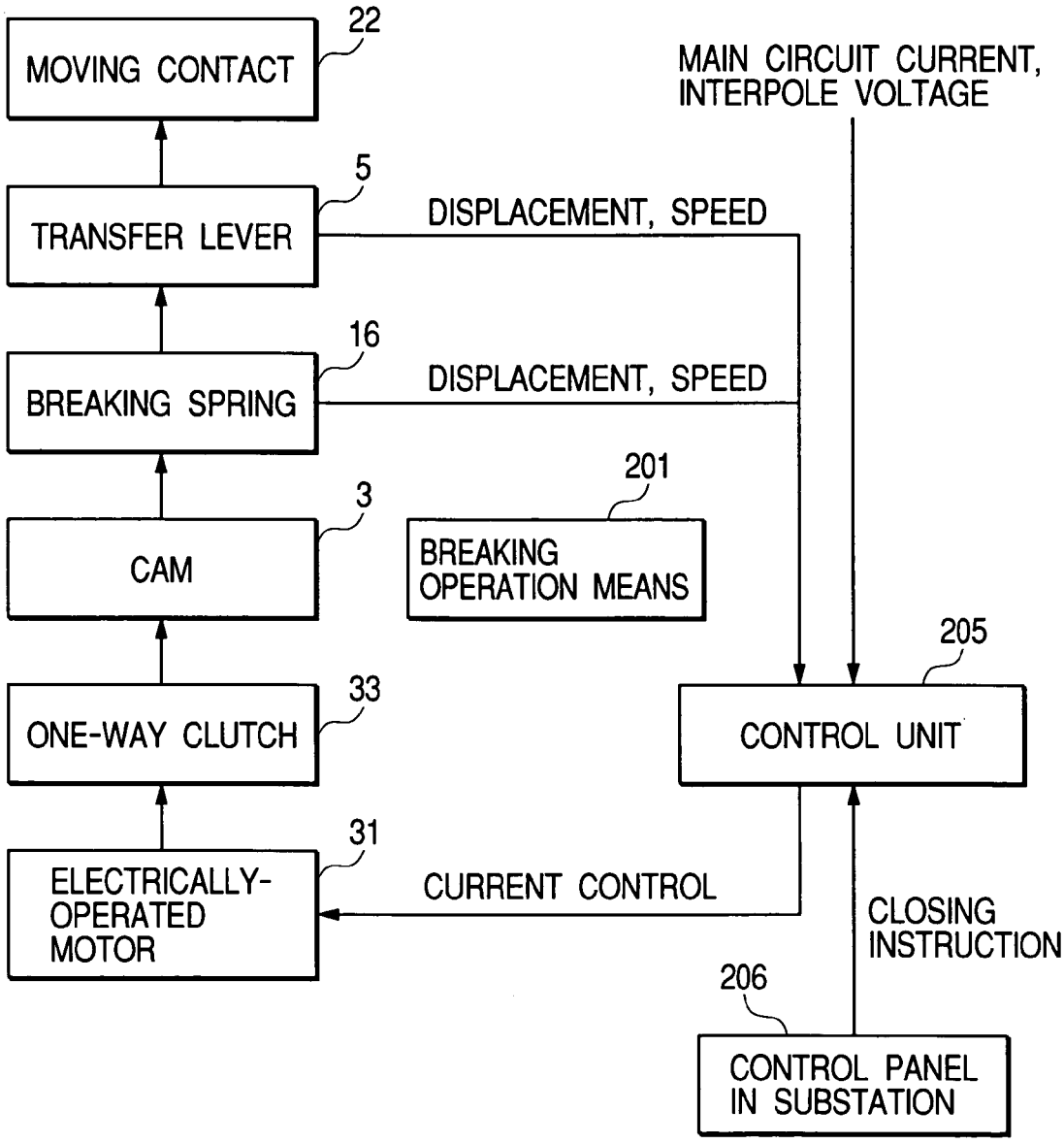
FIG. 7 and FIG. 8 are block diagrams of modifications of the embodiment shown in FIG. 1.
Figure 8:
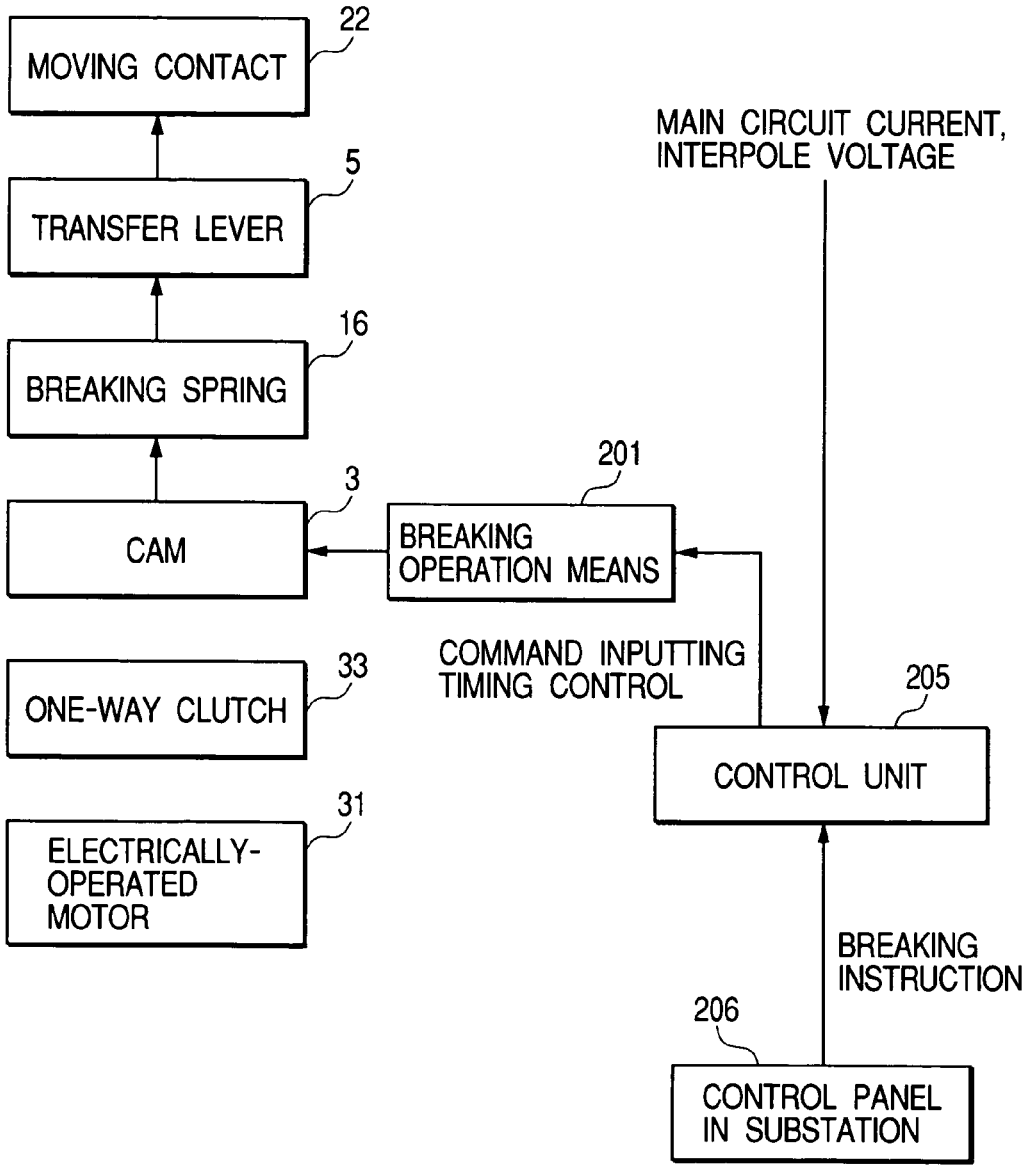

Modifications of the present invention are explained in conjunction with FIG. 7 and FIG. 8. FIG. 7 is a block diagram of the closing operation and FIG. 8 is a block diagram of the opening operation. These modifications and the above-mentioned embodiment are different from each other on following aspects. Although the open/close instruction outputted from a relay panel 206 in the substation is directly inputted to the switching device in the embodiment, the open/close instruction is inputted to a control unit 205 in these modifications. Measured values of a main circuit current and an interpole voltage are also inputted to the control unit 205. At the time of performing the closing operation in FIG. 7, measured values of the displacement and the speed of the transfer lever 5 or the breaking spring 16 are inputted to the control unit 205.

According to these modifications, it is possible to control the moving contact 22 by performing the current control of the motor 31 and it is possible to insert the switching device with a current phase which does not generate an over-voltage and an inrush current. Particularly, even when a friction of a mechanical part is changed due to the change of environmental conditions of surroundings such as temperature or even when wear is generated by operating the switching device a large number of times, the operating characteristics can be compensated for during the closing operation.

Further, in the modification, at the time of performing the opening operation shown in FIG. 8, the timing for inputting an instruction to the breaking operation means 201 from the control unit 205 can be delayed. Since the opening operation is quick compared to the closing operation, the influence which the change of friction and the wear affect the operating characteristics is small. By allowing the control unit 205 to control the timing that the command is inputted to the breaking operation means 201, it is possible to open the contact 204 with the current phase which does not generate the over-voltage or the inrush current. According to the modification, it is possible to perform the phase open/close control of the contact of the switching device and the reliability of operation of the switching device can be enhanced.

Another embodiment of the present invention in which the switching device is constituted of an isolator or a disconnecting switch is explained in conjunction with FIG.

Figure 9:
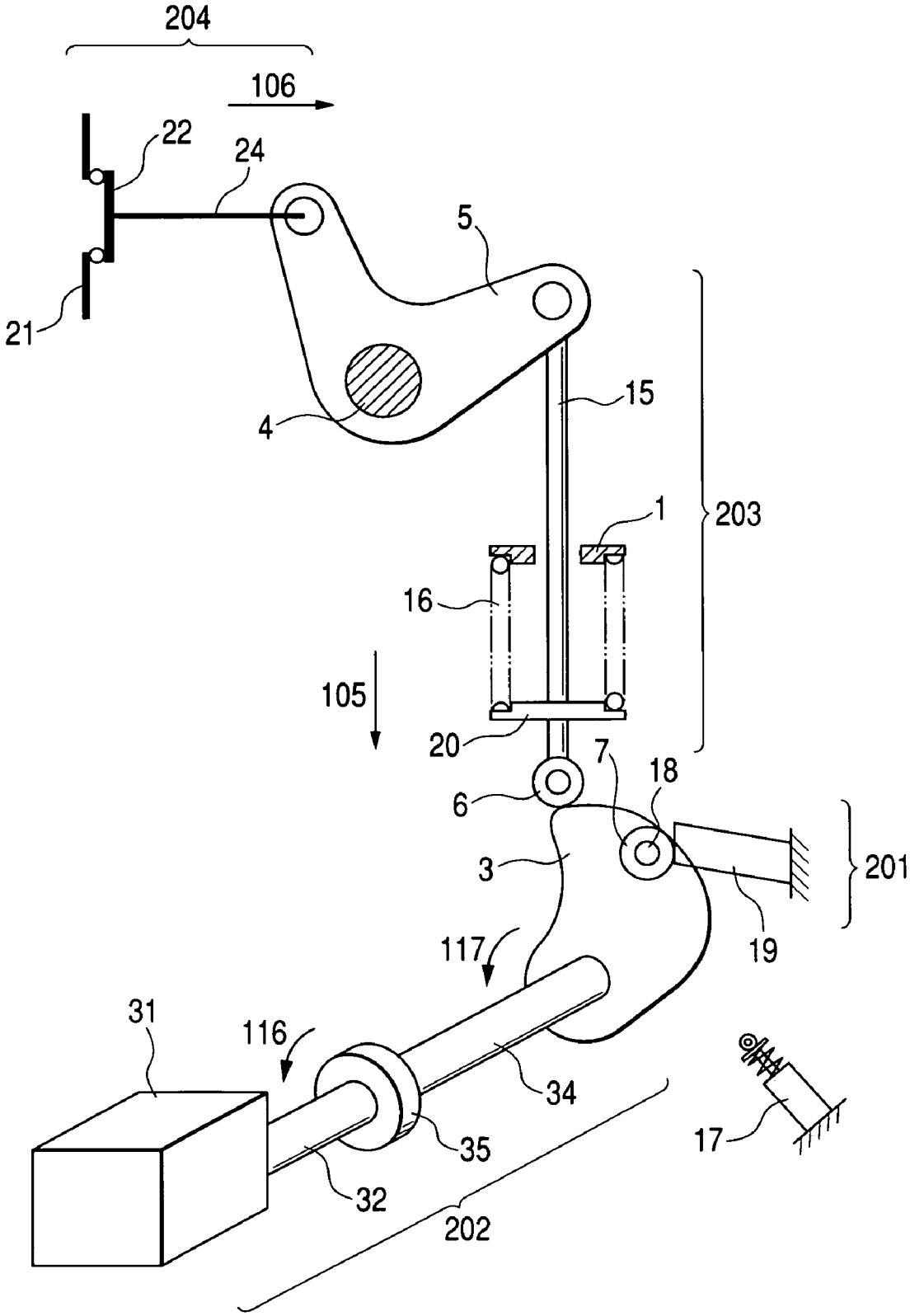
FIG. 9 is a schematic view of another embodiment of a switching device according to the present invention.
Figure 10:
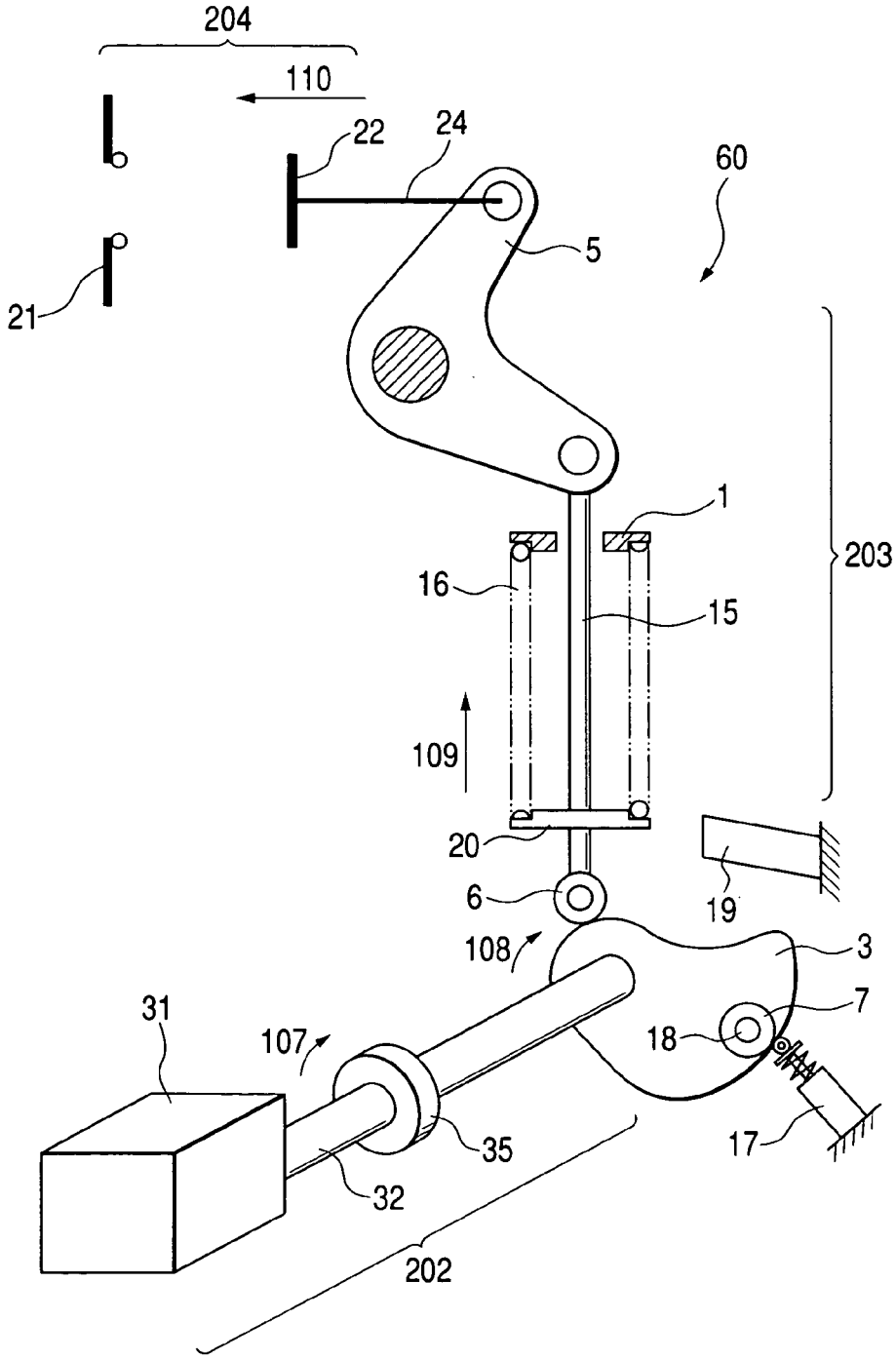
FIG. 10 and FIG. 11 are views for explaining the manner of operation of the switching device shown in FIG. 9.
Figure 11:
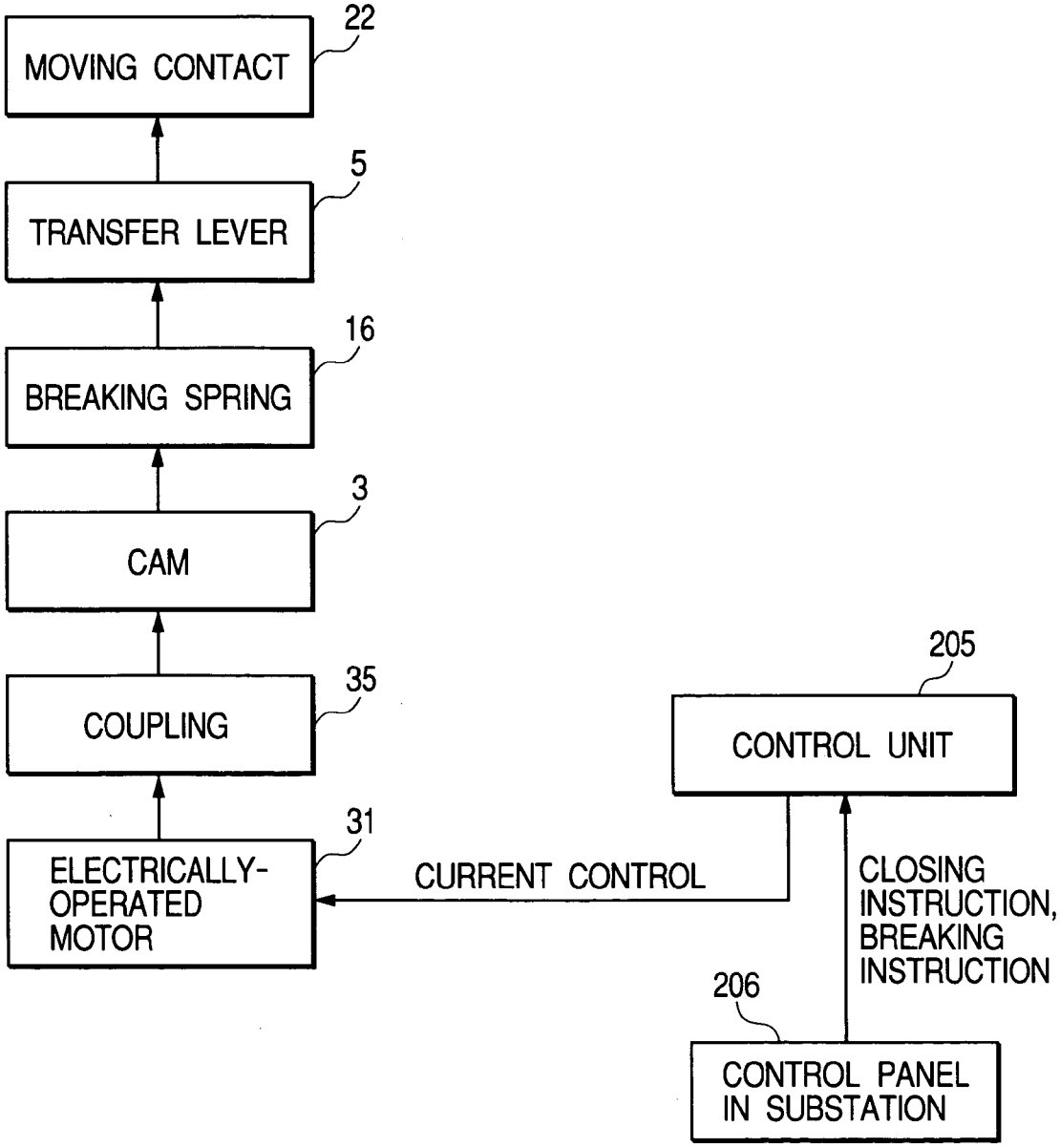

9 to FIG. 11. FIG. 9 is a schematic view of the isolator and shows an closing state. FIG. 10 is a view showing a state that the opening operation is completed. FIG. 11 is a block diagram of an open/close operation. The isolator is defined such that the isolator is operated over an operation period longer than the operation period of the breaker. Accordingly, it is possible to miniaturize a breaking spring 16 and an electrically-operated motor 31 compared to the embodiment shown in FIG. 1. To achieve the reduction of weight and the miniaturization of the switching device, a breaking operation means 202 includes only a stopper 19. The motor 31 is a reversible rotary motor, wherein a motor shaft 32 is connected with a cam shaft 34 using a coupling 35.

In FIG. 11, when a open/close instruction is inputted to a control unit 205 from a relay panel 206 in a substation, the motor 31 is driven so as to open or close the contact. The detail of this operation is explained hereinafter in conjunction with FIG. 9 and FIG. 10. In FIG. 9, a spring force of a compressed breaking spring 16 is transmitted to a cam 3 by way of a roller 6 so as to make the cam 3 rotate in the clockwise direction. The rotation of the cam 3 is restricted, because the roller 7 is brought into contact with the stopper 19.

When a breaking instruction is inputted in this state, the motor 31 is energized and is rotated in the left direction indicated by an arrow 116. When a torque in the clockwise direction, which is generated due to applying of the spring force of the breaking spring 16 to the cam 3, is larger than a driving torque of the motor 31, the motor 31 is not operated. When the driving torque of the motor 31 exceeds the torque caused by the spring force of the breaking spring 16, the cam 3 is rotated in the left direction as indicated by an arrow 117.

When the cam 3 is rotated by a given angle, the motor 31 is stopped. Even when the motor 31 is not driven, the spring force of the breaking spring 16 makes the cam 3 rotate in the left direction as indicated by the arrow 117 by way of the roller 6. When the cam 3 is rotated, the breaking spring link 15 is driven downwardly as indicated by the arrow 105 so that a contact 204 is breaking. The cam 3 is brought into contact with the shock absorber 17 and is stopped. The roller 6 is stopped in a state that the roller 6 is substantially brought into contact with the cam 3.

When an input instruction is inputted to the isolator from the state shown in FIG. 10, the motor 31 is energized. The motor 31 is rotated in the right direction as indicated by an arrow 107. The cam 3 also starts the rotation in the right direction as indicated by an arrow 108 along with the motor 31. Since an outer diameter of the cam 3 is set to the same diameter in peripheral by approximately 180°, the roller 6 is not pushed up during this zone of the same diameter.

When the cam 3 passes the same diameter zone, the cam 3 is rotated so as to push up the roller 6. Along with the pushing up of the roller 6, the breaking spring link 15 is moved upwardly as indicated by an arrow 109 and the breaking spring 16 is compressed. Then, the transfer lever 5 is rotated in the left direction and the moving contact 22 is moved in the left side as indicated by an arrow 110 and the contact 204 is closed. Then, the operation returns to the closing state shown in FIG. 9.

According to this embodiment, the operating apparatus can be simplified and it is possible to miniaturize the isolator in the same manner as the breaker. Accordingly, it is possible to miniaturize equipments in power transmission and transformation station. Further, it is not always necessary to drive the electrically-operated motor 31 during the whole period of the opening operation. When the motor 31 is not driven during the whole period of the opening operation, it is possible to enhance the energy efficiency.

According to the present invention, as the cam is used in both of the breaking operation and the closing operation, the number of parts of the operating apparatus can be reduced and hence, the apparatus can be simplified. Further, due to the simplification of the apparatus, the reliability can be enhanced. Still further, the energy necessary for closing can be reduced and the energy efficiency can be enhanced.

What is claimed is:

1. A switching device which performs breaking and closing of an electric current by opening/closing a contact, the switching device comprising:

an electrically-operated motor which generates energy for closing the contact;

energy accumulation means which accumulates energy generated by rotation of the electrically-operated motor; and transmission means which transmits energy generated by the electrically-operated motor to the contact, wherein the energy accumulation means is arranged in the transmission means, and when the contact is opened, the electrically-operated motor is stopped and the energy accumulated in the energy accumulation means is released.

2. A switching device according to claim 1, wherein the transmission means includes means which transmits the energy generated by the electrically-operated motor to the contact and does not transmit the energy from the contact to the electrically-operated motor.

3. A switching device according to claim 1, wherein a breaking operation means which engages with a the transmission means and restricts the movement of the contact is provided.

4. A switching device according to claim 3, wherein the transmission means includes a cam shaft, a cam which is mounted on an end portion of the cam shaft, a roller which is brought into contact with the cam, a breaking spring link which has the roller connected to one end portion thereof, and a transfer lever which is mounted on another end portion of the breaking spring link, wherein the energy accumulation means is held by the breaking spring link.

5. A switching device according to claim 3, wherein a second roller is mounted on the cam, and a breaking operation means includes a breaking lever which engages with the second roller, a breaking trigger which is brought into contact with the breaking lever and a solenoid which activates the breaking trigger.

6. A switching device which changes over breaking and closing of an electric current by opening/closing between a fixed contact maker and a movable contact maker, the switching device comprising:

accumulation means which releases accumulated energy when the electric current is breaking and accumulates energy for breaking when an electric current is inserted, and an electrically-operated motor which is mechanically connected to the accumulation means and accumulates a breaking energy, wherein when the electric current is broken, energy generated by the electrically-operated motor is transmitted to the movable contact maker.

7. A switching device according to claim 6, wherein the switching device includes means which does not transmit power from the accumulation means to the electrically-operated motor and transmits the power from the electrically-operated motor to the accumulation means and control means which controls the electrically-operated motor.

8. A switching device according to claim 7, wherein the control means controls the operation timing of the electrically-operated motor based on an electric current for a main circuit provided to the switching element, a voltage between poles and displacement and speed of the movable contact maker which are inputted to the control means.

9. A switching device according to claim 6, wherein the accumulation means includes at least either one of a cam and a spring.

10. A switching device according to claim 6, wherein the switching device is at least either one of a breaker or an isolator for electric power.

11. A switching device which changes over breaking and closing of an electric current by opening/closing between a fixed contact and a moving contact, the switching device comprising:

a spring which accumulates energy for the breaking of the electric current;

a cam which releases the spring in an opening operation and transmits energy to the spring in a closing operation;

an electrically-operated motor which generates an closing energy and is mechanically connected to the cam;

a breaking operation means which restricts rotation of the cam; and control means which controls the electrically-operated motor and the breaking operation means, wherein the control means controls timing in which the energy of the spring is transmitted from the cam to the breaking operation means in a closing holding state and a command is inputted to the breaking operation means at the time of performing the breaking operation, and the control means controls the driving current of the electrically-operated motor at the time of performing the closing operation.

* * * * *